United States Patent [19]

Klein

[11] Patent Number: 5,009,316

[45] Date of Patent: Apr. 23, 1991

[54] TEST TUBE CASSETTE SYSTEM AND CASSETTES FOR USE THEREIN

[76] Inventor: David C. Klein, 20 Redding Ridge Dr., Gaithersburg, Md. 20878

[21] Appl. No.: 350,843

[22] Filed: May 12, 1989

Related U.S. Application Data

[62] Division of Ser. No. 174,855, Mar. 29, 1988.

[51] Int. Cl.[5] ..... B65D 85/20

[52] U.S. Cl. ..... 206/443; 220/516; 220/23.86

[58] Field of Search ..... 206/443; 220/21, 516, 220/23.86, 27.83, 500

[56] References Cited

U.S. PATENT DOCUMENTS

| | | | |
|---|---|---|---|
| 2,743,030 | 4/1956 | Read, Jr. | 220/21 |
| 3,092,284 | 6/1963 | Stout | 220/21 |
| 3,341,053 | 9/1967 | Keene | 220/21 |
| 3,349,937 | 10/1967 | Duff et al. | 217/25.5 |
| 3,744,661 | 7/1973 | Fischer, Jr. | 220/21 |
| 3,955,704 | 5/1976 | Smith et al. | 220/21 |
| 4,142,633 | 3/1979 | Raghavachari et al. | 206/443 |
| 4,257,520 | 3/1987 | Hohmann et al. | 206/443 |
| 4,446,104 | 5/1984 | Hammerling et al. | 422/63 |
| 4,510,119 | 4/1985 | Hevey | 206/443 |
| 4,538,723 | 9/1985 | Johnson et al. | 206/443 |
| 4,549,656 | 10/1985 | Barnes et al. | 220/21 |
| 4,671,405 | 6/1987 | Hagan | 220/21 |

OTHER PUBLICATIONS

Titertube 1 ml Micro Test Tubes 1 ml for Efficient Storage, Sample Preparation, and Use with Microtitration Plates brochure (not dated).

*Immunology*, "MicroWell Modules" brochure (not dated).

*Immunology*, "HLA Plates" brochure (not dated).

*Primary Examiner*—Joseph Man-Fu Moy

*Attorney, Agent, or Firm*—Marks Murase & White

[57] ABSTRACT

A test tube cassette system and cassettes for use therein. Each cassette has a plurality of sample storage test tubes formed therein. The walls of the test tubes are planar thus providing superior optical characteristics. The cassettes are preferably molded of optically clear crystal polystyrene styrene. The test tubes cassette system also includes a rack for supporting and precisely positioning a plurality of cassettes. The system may also include either a plurality of stoppers for sealing the test tubes or a filter cassette adapted for insertion into the test tubes.

In accordance with a further preferred embodiment of the invention, the test tube cassette system of the present invention is particularly well adapted for automatic processing of the samples contained within the test tubes of the cassettes.

16 Claims, 11 Drawing Sheets

Fig. 3A
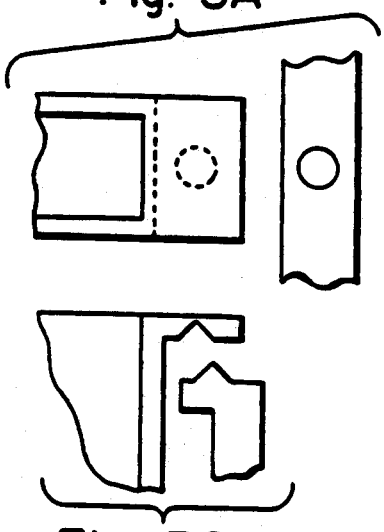
Fig. 3C
Fig. 3B
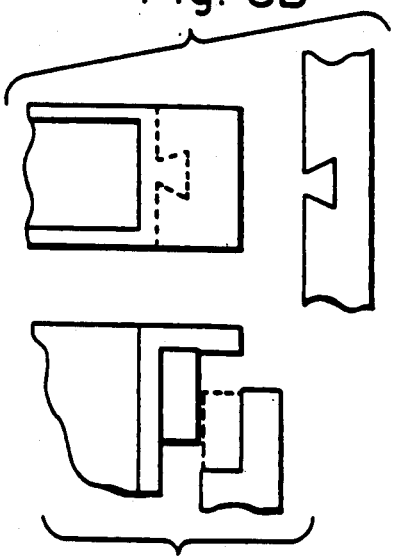
Fig. 3D
Fig. 3E
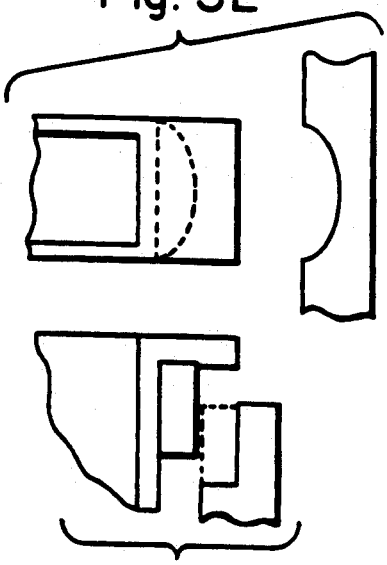
Fig. 3G
Fig. 3F
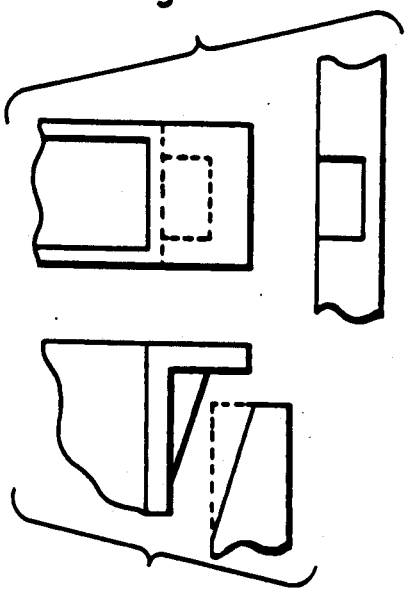
Fig. 3H Fig. 7A
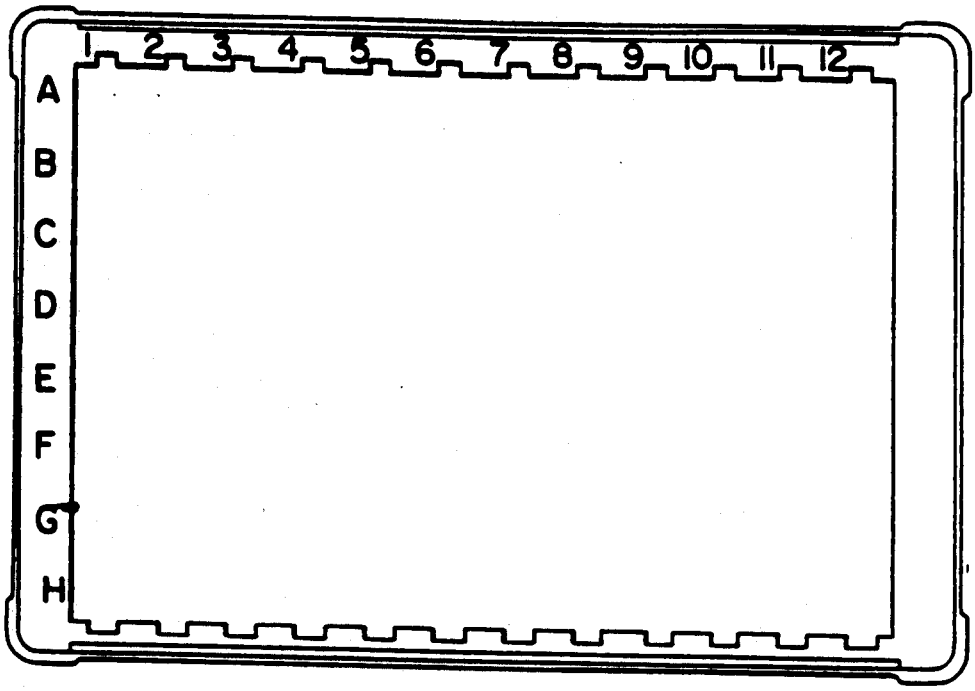
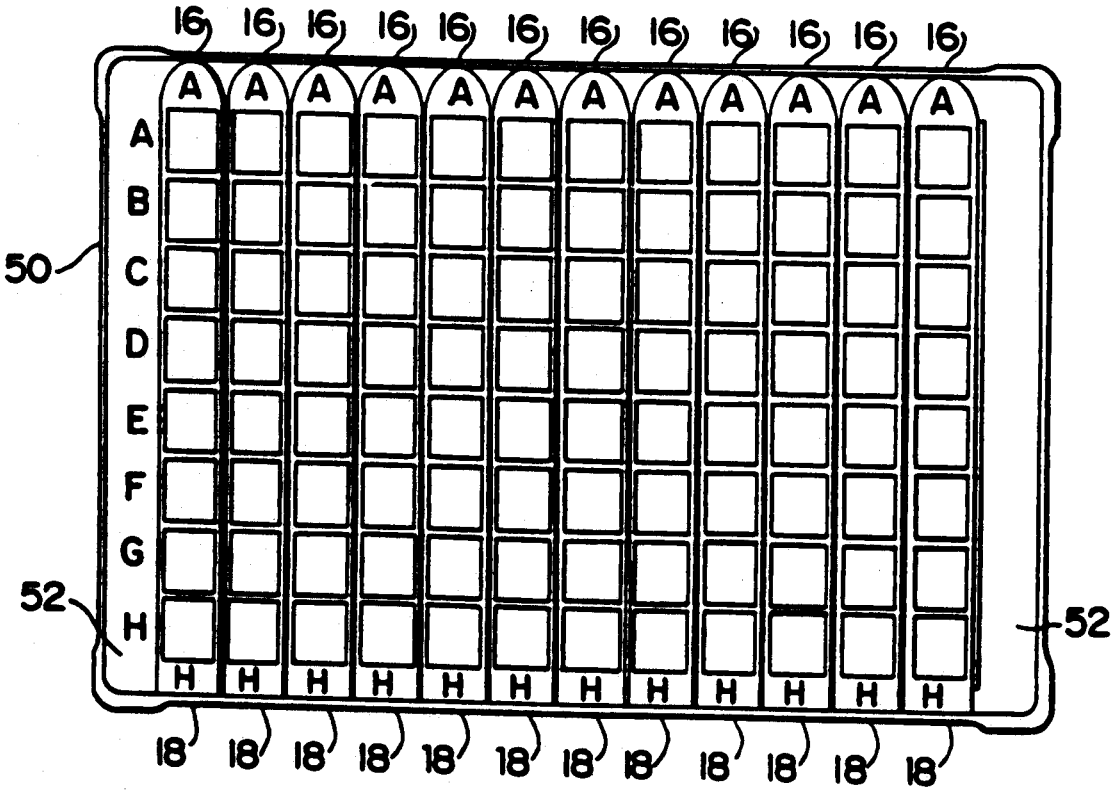
Fig. 7B Fig.8A
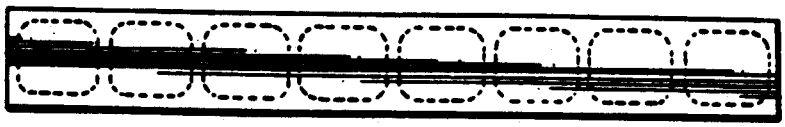
Fig. 8B
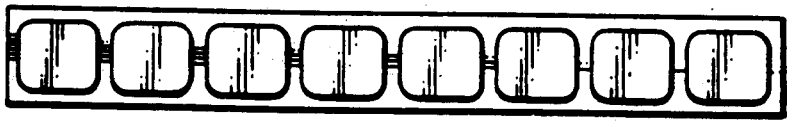
Fig. 8C
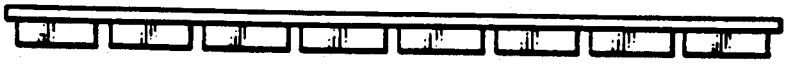
Fig. 8D
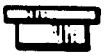
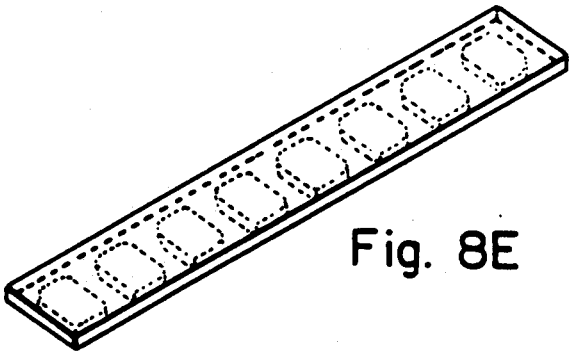
Fig. 8E

TEST TUBE CASSETTE SYSTEM AND CASSETTES FOR USE THEREIN

This is a division of application Ser. No. 07/174,855 filed Mar. 29, 1988.

BACKGROUND OF THE INVENTION

This invention relates to a sample container system which is preferably compatible with the industry standard 96-well microtiter plate system. Such a plate system is disclosed in U.S. Pat. No. 3,349,937 to Duff et al. The present invention particularly relates to a test tube cassette system which is preferably constructed on an 8×12–0.354 inch on center geometry so as to allow it to interface with the standard 96-well microtiter plate. Such construction allows known pipeting equipment, such as disclosed in U.S. Pat. No. 4,446,104 to Hammerling et al., to be used to transfer multiple samples from the test tube cassette system into 96-well plates for further analysis. While this particular field of the invention is preferred, it will be recognized that certain aspects of the present invention are applicable outside the specific field discussed hereinabove.

A variety of test tube rack constructions are known. It is also known to provide a disposable rack of 96 micro test tubes for use in conjunction with microtitration plates and the pipeting equipment used therewith. One example of such a system is the Bio-Rad 1 ml. Titertube micro test tubes which are available in racks of 96 micro test tubes which match the spacing of multi-channel pipets, micro titration plates and MTT-rack pipet tips. The system also provides for polyethylene plugs to be provided in strips of eight plugs for sealing the micro test tubes. These strips of eight plugs may be cut apart to isolate the tubes.

Other known sample storage systems include the Skatron 1.0 and the 1.4 ml Microwell tubes. These individual round tubes are available in flexible strips of 12 attached at the top by means of a breakaway element. Stoppers are not available. Another sample storage system is the Nunc Microwell Module system. This system consists of a plastic frame and individual modules. Modules are available either strips of 2×8 round wells or 1×8 round wells. Each well has a volume of 0.3 or 0.4 ml.

The aforementioned known sample storage systems suffer from a number of disadvantages. For instance, the small volumetric capacity of the individual tubes of known sample storage systems precludes the collection of samples large enough to perform many different types of tests on the same sample and to perform repeated analysis on the same sample. The small compartment also precludes the collection of large samples required for chemical or enzymatic reactions for analytical purposes which require large volumes because the solutes or biological materials including receptors and hormones are present in low concentration. Further, in the case of identification of components of chromatographic separation, the small sample size limits the number of different types of tests on the same sample and the ability to perform repeated analysis on the same sample.

Further, known systems typically utilize tubes which are round. These round tubes are inefficient in terms of volumetric capacity. Moreover, the curved walls of these round test tubes adversely effects the optical characteristics of the tubes for at least two reasons. First, the curved walls provides less uniform light transmission than is possible with planar side walls. Second, the variable light path available in the conventional 96-well plate is less desirable than the fixed light path available when planar side walls are employed.

SUMMARY OF THE INVENTION

The present invention overcomes the above-noted deficiencies in prior art sample storage systems. More specifically, the present invention provides a sample storage system in which each sample tube has an increased volumetric capacity, planar side walls to provide superior optical characteristics and is fixed in position relative to adjacent tubes in the cassette. Further, the sample cassettes of the present invention are designed so that they may be suspended in a bottomless rack so that the cassettes can be pushed up from the bottom of the rack which enables the samples to be automatically processed. Further, the cassettes and rack are designed such that the individual sample tubes are precisely positioned with respect to the rack.

In accordance with another aspect of the present invention, the test tube cassette system is compatible with filter cassette devices which will separate molecules on the basis of size, charge, immunological features or other physical or chemical characteristics. Specifically, samples will be applied to the filter and then forced through the filter by centrifuging, the filter center samples will be collected in the cassette compartments. The size of the compartments of the storage system of the present invention allows for the filtration of 96 samples at the same time of volumes five to ten times greater than that which is currently available.

BRIEF DESCRIPTION OF THE DRAWINGS

FIG. 3 is a detail view of alternative cassette positioning constructions in accordance with the present invention.

FIG. 3(A) is a top detail view of a first positioning construction.

FIG. 3(B) is a top detail view of a second positioning construction.

FIG. 3(C) is a side detail view of the first positioning construction of FIG. 3(A).

FIG. 3(D) is a side detail view of the second positioning construction of FIG. 3(B).

FIG. 3(E) is a top detail view of a third positioning construction.

FIG. 3(F) is a top detail view of a fourth positioning construction.

FIG. 3(G) is a side detail view of the third positioning construction of FIG. 3(E).

FIG. 3(H) is a side detail view of the fourth positioning construction of FIG. 3(F).

FIG. 7(A) is a top view of an empty rack.

FIG. 7(B) is a top view of a rack filled with cassettes.

FIG. 8 is a set of views of a stopper strip.

FIG. 8(A) is a top view of the stopper strip.

FIG. 8(B) is a bottom view of the stopper strip.

FIG. 8(C) is a side view of the stopper strip.

FIG. 8(D) is an end view of the stopper strip.

FIG. 8(E) is a perspective view of the stopper strip.

FIGS. 10(A)-(F) illustrate a filter cassette in accordance with a preferred embodiment of the present invention.

DETAILED DESCRIPTION OF THE INVENTION

Figure 1A:
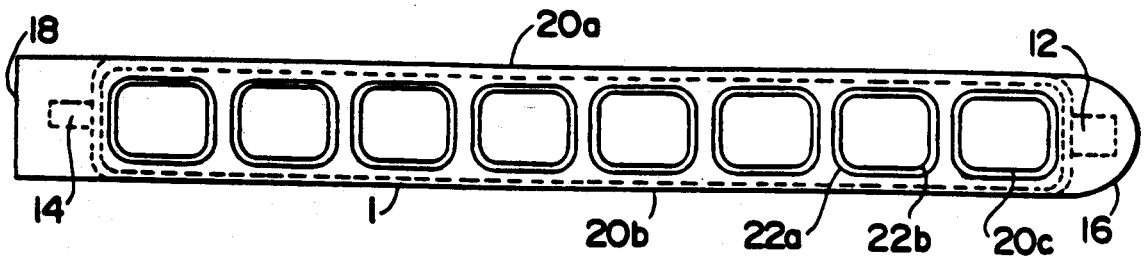
FIGS. 1(A) and 1(B) are top and side views of a sample storage cassette according to the present invention
Figure 1B:
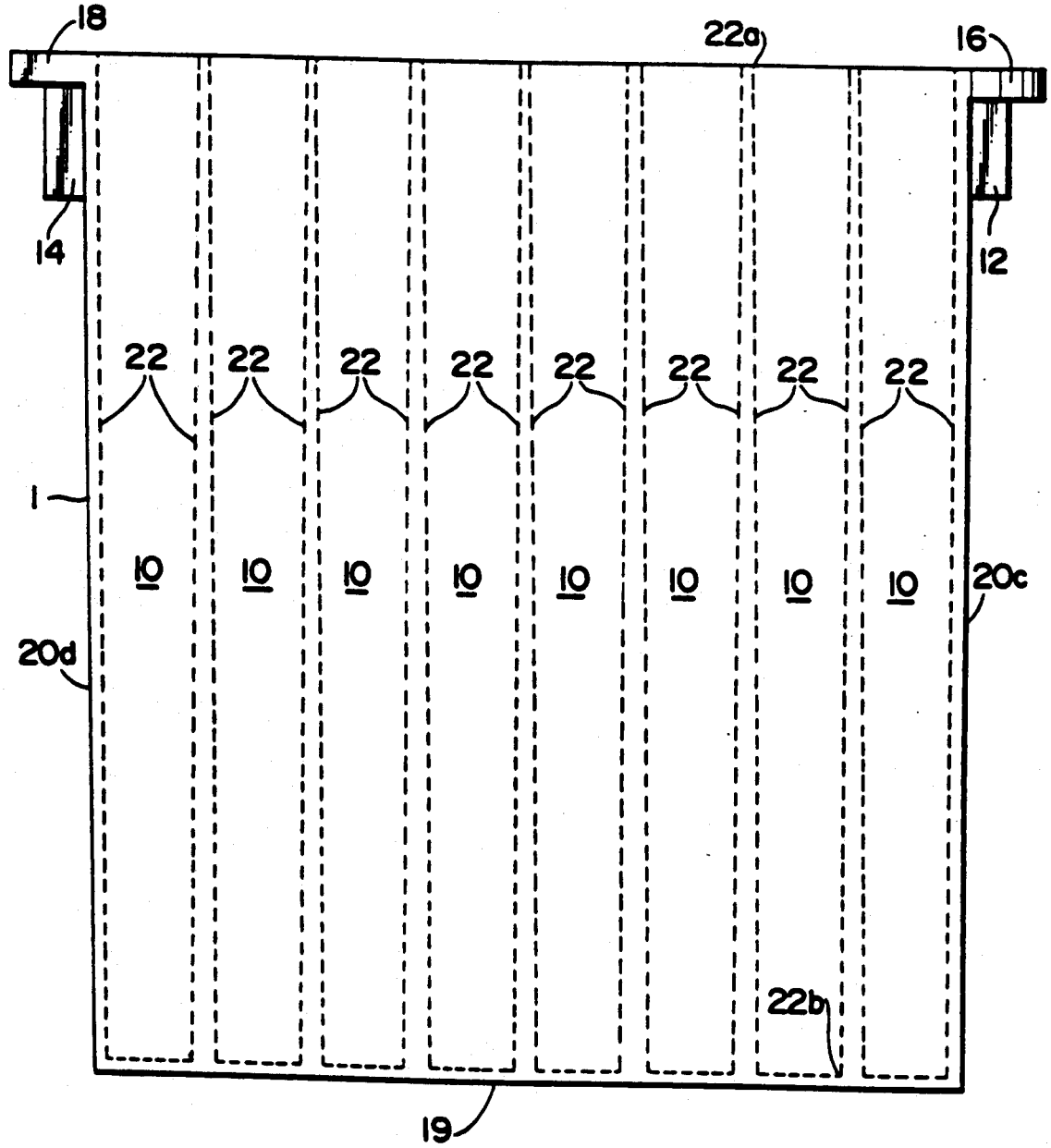

FIGS. 1(A) and 1(B) are top and side views, respectively, of a single cassette of the test tube cassette system of the present invention. The cassettes are preferably molded of crystal polystyrene which allows the cassette to be used for spectrophotometric analysis and gives an enhanced appearance. In the preferred embodiment, the molded finish provides optical clarity on both sides and the bottom to allow several types of transmission spectrophotometric analysis of the contents of each compartment. However, if the bottom of the cassette is not optically clear, the cassette will still be useful for transmission work. If none of the surfaces of the cassette are optically clear, the use of the cassette will be limited in use to liquid storage.

As shown in the top view of FIG. 1(A) each cassette includes a number of sample storage test tubes 10, preferably eight, twelve or a multiple thereof, which are generally rectilinear in cross-section. This rectilinear configuration maximizes space utilization for sample storage. The sample storage test tubes 10 are separated from one another by tapered dividing walls 22. The walls are tapered a very small amount (preferably less than 1°) inwardly toward the bottom of the cassette. The tapering is most evident in FIG. 1(A) where it can be seen that the lower edge surface 22(*b*) of the tapered walls 22 has a smaller perimeter than the upper edge 22(*a*). It should be noted that the use of divider walls means that adjacent test tube compartments share walls, this yields savings both in terms of space and in plastic used to mold the compartments. Additionally, each test tube compartment 10 includes a pair of planar side walls 11 defined by portions of the longitudinal planar side walls 20(*a*), 20(*b*) of the cassette.

Figure 2:
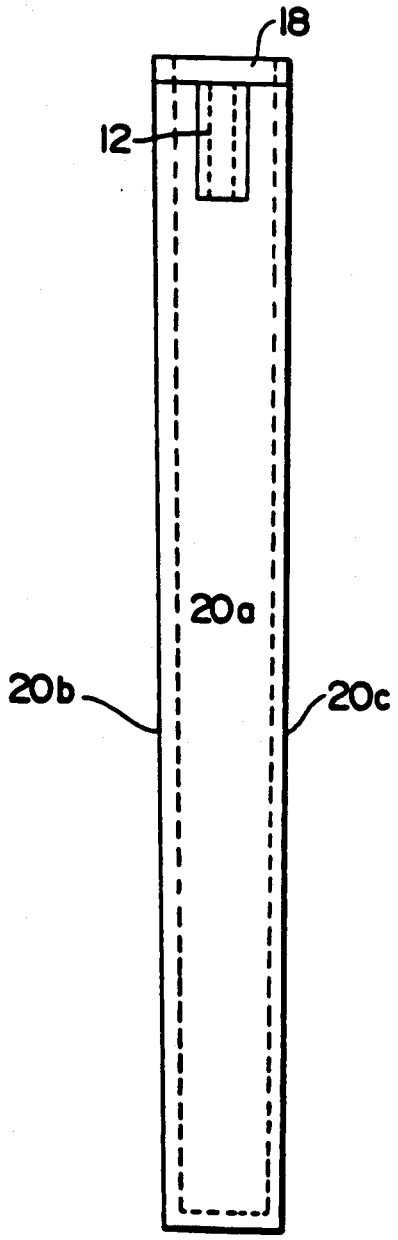
FIG. 2 is a end view of the cassette shown in FIG. 1.

As shown in FIGS. 1(A), 1(B) and FIG. 2, the cassette also includes planar side walls 20(*a*)-(*d*), a planar front extension 16, a planar rear extension 18 and a rectilinear base 19. The planar side walls 20(*a*)-(*d*) extend transversely upward from said base at side edges of said rectilinear base. The planar side walls include two parallel end side walls 20(*d*) and 20(*e*) and two parallel longitudinal side walls 20(*a*) and 20(*b*). The base and planar side walls each include four side edges.

The cassette also includes front and rear cassette locating projections 12 and 14, respectively. When used in conjunction with the rack system, of the test tube cassette system of the present invention, the projections 12 and 14 are received in complementary projection receiving grooves in the cassette rack. As best seen in FIG. 1(A) the projections 12 and 14 are not the same size. In fact, in the embodiment shown in FIG. 1(A) the front projection 12 is substantially larger than the rear projection 14. Provision of different sized front and rear projections provides a simple safety feature in that the larger of the two projections, in this case the front projection 12, cannot be received in the complementary groove in the rack which is adapted to receive the rear projection 14. Accordingly, the cassette can only be oriented in one way in the rack such that the cassette cannot be accidentally placed backward in the rack.

While the front and rear protrusions 12 and 14 shown in FIGS. 1 and 2 are rectilinear in shape, other shapes are possible, as detailed in FIG. 3. For example, it is possible to taper the side walls of at least one of the protrusions and its complementary groove in the rack such that any play between the cassette and the rack is substantially eliminated. Additionally, it is possible to substitute for the front and rear protrusions, either a conical recess or a conical protrusion formed in the planar extensions 16, 18 and adapted to receive a complementary protrusion or recess in the rack.

While it is obviously possible to dimension the cassette shown in FIGS. 1 and 2 to any desired size, particular advantages accrue when the cassette is dimensioned so as to be compatible with liquid handling equipment developed for 96-well microtiter plates. Accordingly, in the preferred embodiment of the present invention, the test tube cassette is precisely dimensioned for compatibility with the industry standard 96-well microtiter plate system. Specifically, in the preferred embodiment the x-y geometry of the cassette is based on the industry standard 96-well microtiter plate (eight columns of 12 wells on 0.354 inch centers) and is fixed. As used herein, the term "center" refers to the geometric center of the cross sectional area. In the case of a substantially rectangular cross section, the geometric center is the point which is equidistant from each of the sides of the two pairs of parallel opposed sides of the rectangle. Moreover, the term "axis" refers to the line extending through the geometric center in the Z direction.

The maximum outside dimensions of a set of 12 cassettes of eight compartments will be 2.882×4.248 inches. In the z direction the cassette is preferably 3 inches deep so that each compartment will hold at least 3.0 ml. or double that available in conventional product-individual tubes. The 3 inch depth, while preferred, is not necessary to compatibility with the industry standard 96-well microtiter plate. At the upper portion of the cassette the walls are 0.05 inches thick and the thickness increases toward the lower portion of the walls because of the taper of the wall. Again, this dimension not dictated by compatibility with the industry standard 96-well plate.

As noted above, the walls are tapered at less than one degree. In the preferred embodiment, the walls are tapered at 0.25 degrees. While a greater degree of taper is possible, it produces the undesirable effect of reducing the cross sectional area of the compartment and increasing the amount of plastic needed to mold the cassette.

The cassette is designed to be 0.344 inches wide outside allowing 0.1 inches between cassettes which are spaced 0.354 inches on center. This space is required to accommodate a label and provides sufficient space for easy removal of a cassette packed rack without binding.

Each of the eight individual test tubes are constructed as rectilinear as possible to maximize cross section and minimize plastic. At the top of the test tubes, the dimensions are preferably 0.304 times 0.244 inches and with a 0.25 degree taper, the bottom of said dimensions are 2.78 inches times 2.19 inches.

One aspect of the present invention should now be evident. Specifically, since each cassette contains, for example, eight test tubes 10, which are precisely spaced and fixed with respect to one another, the spacing of the test tubes of each individual cassette is rigidly maintained. Further, when the cassettes are placed in a rack having cassette locating means cooperating with the cassette locating protrusions or the like of the cassettes to maintain the spacing of the cassettes with respect to one another in a no-play state, the distance between the test tubes of adjacent cassettes is rigidly fixed. Accordingly, each test tube in the entire array of sample storage test tubes (96 total tubes in the preferred embodiment) is precisely positioned with respect to all the other tubes, within, of course, the limits of manufacturing tolerances.

Figure 4:
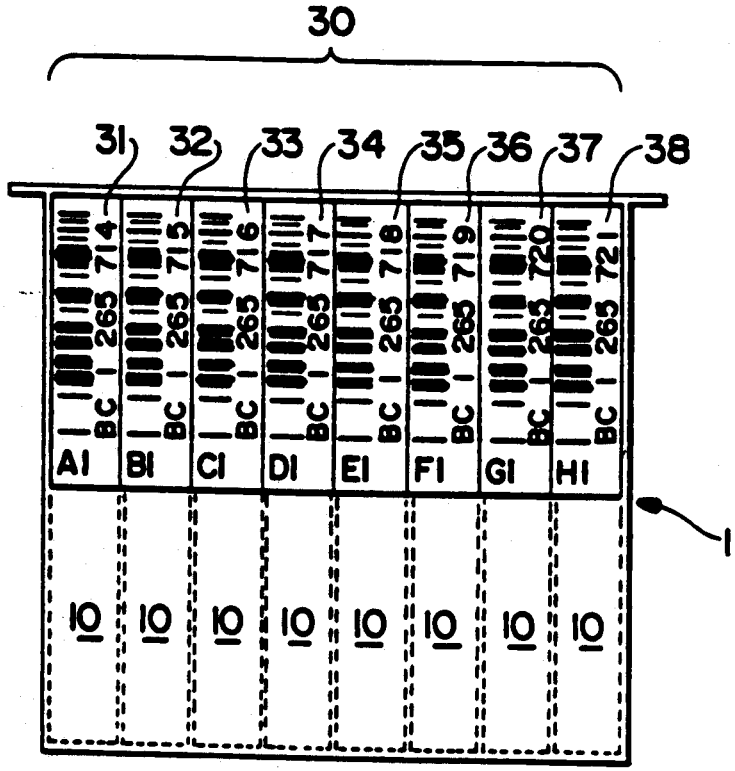
FIG. 4 is a side view of a cassette having a label thereon.

Another aspect of the present invention is illustrated in FIG. 4. Specifically, the planar surface of each cassette 1 is particularly well suited to labelling such as with bar codes and/or alphanumeric codes to identify the contents of each test tube of the cassette. In the example shown, the cassette 1 is labelled with both a bar code and alphanumeric symbol identifying the contents of each of the eight test tubes 10 in the cassette 1. The alphanumeric code can be used to identify each compartment according to the convention, e.g., A1 to A12 and H1 to H12. Because the cassette 1 has a continuous planar side wall, the label 30 may be in a form of a single continuous label having printed thereon eight bar codes and/or alphanumeric codes spaced apart so as to identify the contents of each of the eight test tubes. Alternatively, eight individual labels 31-38 may be placed on the cassette 1 to identify the contents of each of the eight test tube compartments.

The precise printing of eight parallel bar codes on a single label and the ease of precise alignment of the label along the linear dimensions of the cassette improve the precision and reliability of reading the codes by automated devices using bar code readers. This makes it possible to conduct simultaneous photoelectronic analysis of the label and the contents of the compartment, and to concurrently generate and transmit electronic signals encoding both sample identification and analysis data, with the sample in a single fixed position.

Preferably, a bar code and/or alphanumeric code is associated with each of the test tubes 10 and the code is associated with the contents of the test tube after the contents are placed within the test tube. In other words, the bar codes and/or alphanumeric codes can be placed on the cassette before the cassette is actually used to store samples. Then after a sample is placed in each particular tube, the identity of the sample is associated with the bar code or alphanumeric code identifying that particular test tube. Alternatively, the bar code or alphanumeric code can be associated with a particular sample before it is attached to a particular tube. However, care must then be taken to ensure that label is used to identify the same test tube as used to store the sample which it identifies.

Figure 5:
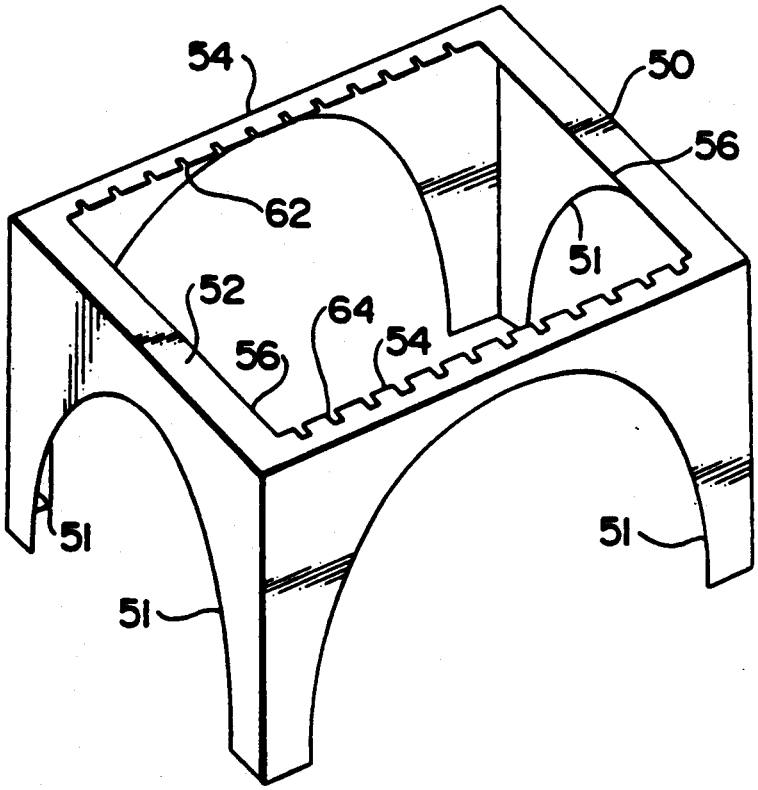
FIG. 5 is a perspective view of a cassette rack of the cassette system of the present invention.
Figure 5A:
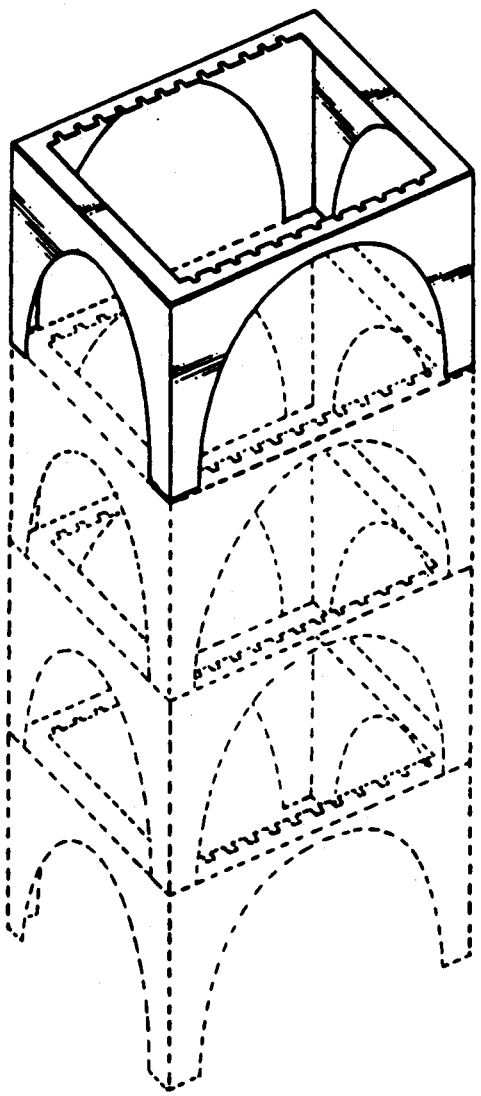
FIG. 5*b* is a perspective view of empty stacked racks.
Figure 6:
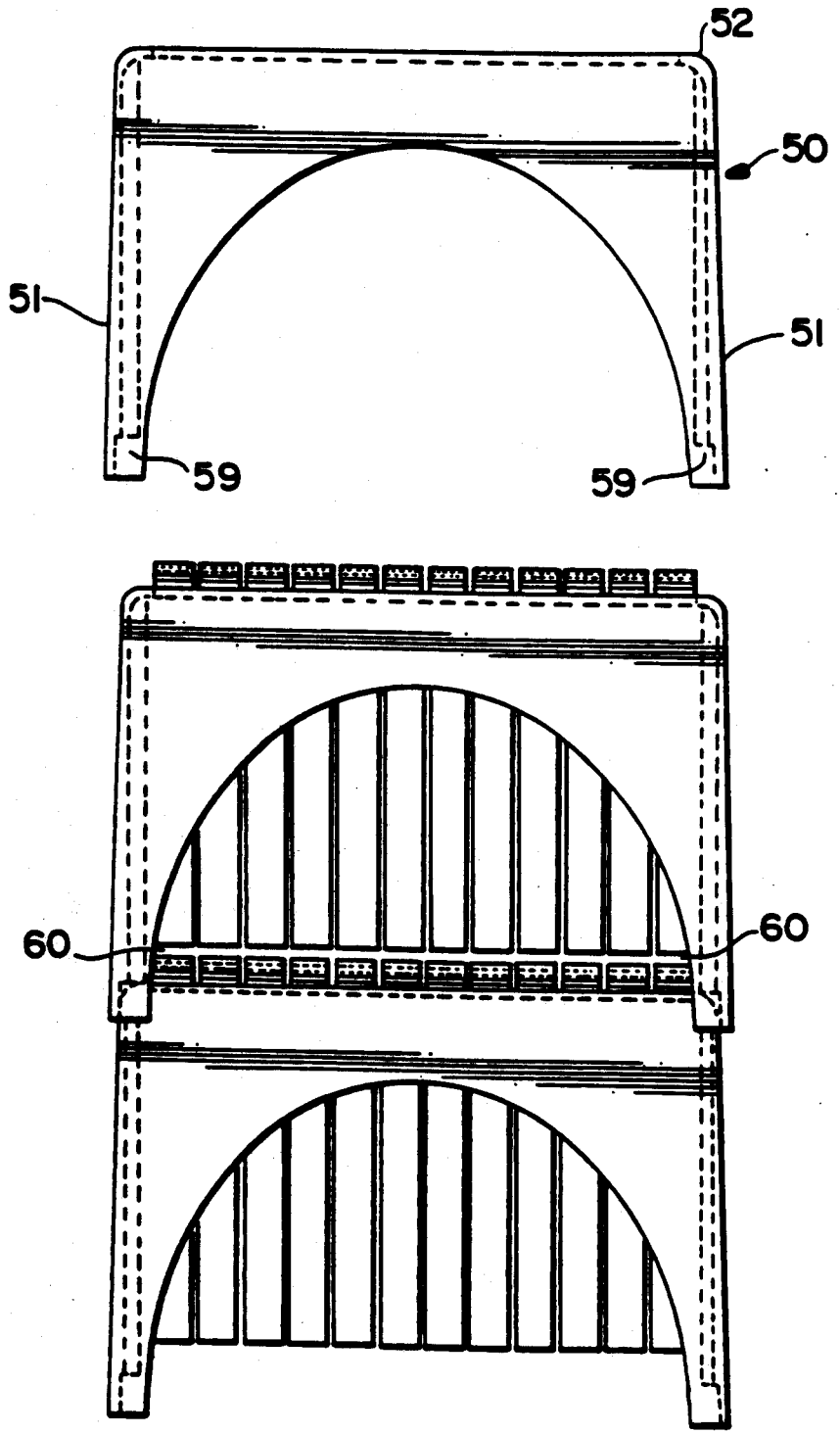
FIG. 6 is a side view showing a number of racks in the stacked condition.

FIGS. 5, 5(A) and 6 illustrate the disposable plastic rack of the test tube cassette system of the present invention. As shown in FIG. 5, the rack 50 includes four legs 51 and an upper support surface 52. The upper support surface 52 includes opposed parallel side edges 56 and opposed parallel longitudinal edges 54. The longitudinal edges 54 are provided with means 62 and 64 complementary to the cassette locating means 12 and 14 of the cassettes for precisely locating each cassette. In accordance with the preferred embodiment illustrated in FIG. 1, the means 62 and 64 comprises grooves or notches adapted to receive the protrusions 12 and 14 of the cassettes. However, as noted above, the locating means 62, 64 may comprise any form of positioning means provided such means are complementary to the cassette positioning means 12, 14 employed in each of the cassettes.

The upper support surface 52 of the rack is adapted to support the planar extensions 16, 18 of each cassette and thereby support the entire cassette. As shown in FIG. 5, one preferred embodiment of the cassette rack is adapted to support twelve separate cassettes each having eight test tube compartments. According to another preferred embodiment, the rack is designed to support eight cassettes each having twelve test tube compartments. Further, the spacing of the cassettes as determined by the cassette locating means 12, 14 and 62, 64 is such that the entire array of, for example, 12 cassettes each having eight test tubes (96 total test tubes) is precisely positioned.

As is evident from FIG. 5, the rack 50 supports the cassettes 1 solely at their top edges such that the rack does not interfere with access to the bottom of the cassettes supported therein. This allows the cassettes to be pushed up from the bottom of the rack.

As best shown in FIG. 6, the legs 51 of the rack 50 are tapered outwardly away from the upper support surface 52. In addition to offering increased stability, the outward tapering of the legs 51 provides increased access to the bottom of the cassettes 1 and allows a plurality of racks 50 to be stacked one on top of another as illustrated in FIG. 6.

As shown in FIG. 6, each of the legs 51 of the rack 50 includes a leg abutment 59 which rests upon the upper support surface 52 of another rack 50 in the stacked state. As also shown in FIG. 6, when racks 50 containing cassettes 1 are stacked on top of each other a space 60 is maintained between the cassettes contained in the adjacent racks. Accordingly, the rack is particularly well suited for stacking.

FIG. 7(A) is a top view of an empty rack 50. FIG. 7(B) is a top view of a rack 50 filled with 12 cassettes. As viewed in FIG. 7(B), the overlap of the planar surfaces 18 and 16 of the cassettes on the upper support surface 52 of the rack 50 is particularly evident.

Each test tube compartment is capable of receiving a stopper to seal the compartment. Preferably, the stoppers are provided on strips having a number of stoppers equal to the number of compartments in each cassette (e.g. eight or twelve). FIG. 8 shows one embodiment of the stopper in which eight stoppers 88 are provided on a stopper strip 80.

Figure 9:
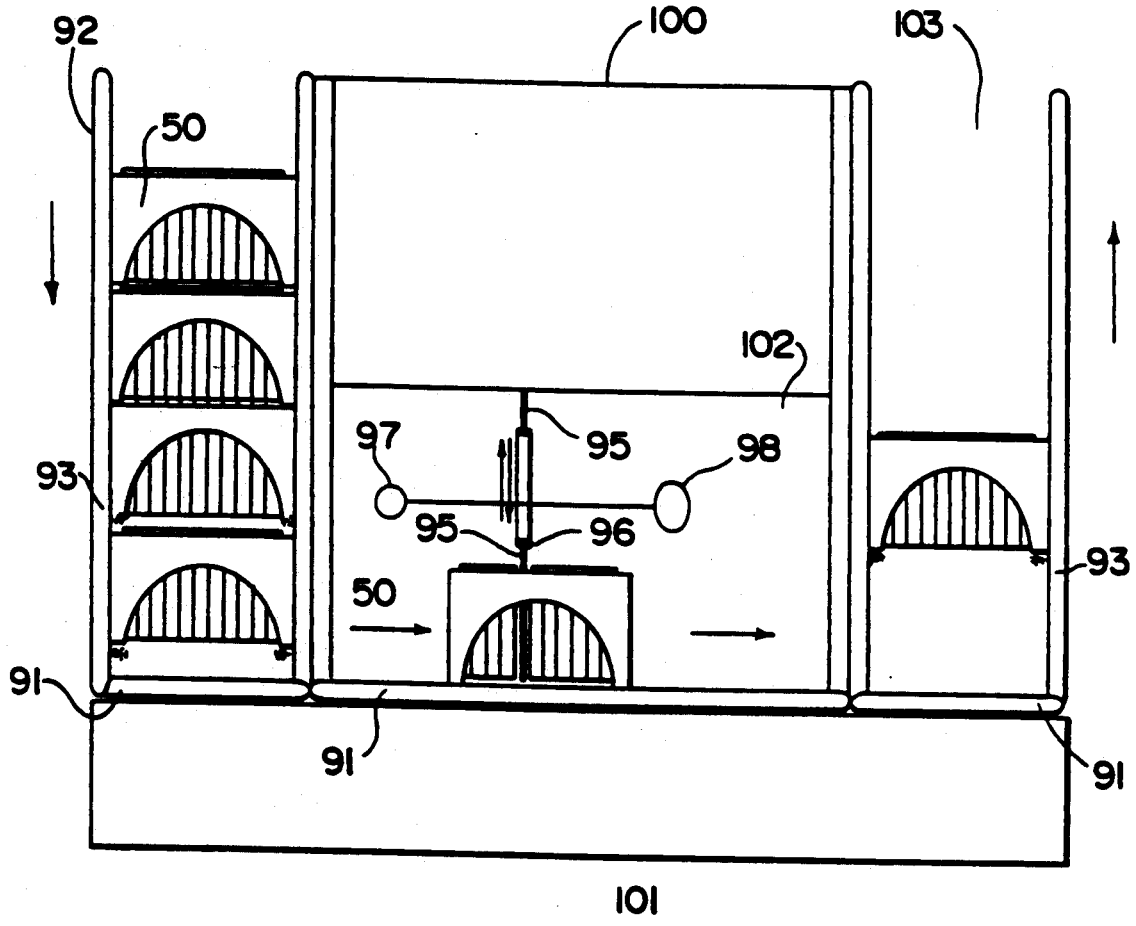
FIG. 9 is a schematic representation of a spectrophotometer with automatic cassette changing using racks of test tube cassettes.

FIG. 9 schematically illustrates another unique feature of the test tube cassette system of the present invention. In particular, the cassette system is designed so that the cassettes 1 are suspended in the bottomless rack 50. This arrangement allows for automatic sample processing in which an automatic sample changer (not shown) positions the rack 50 so that each cassette 1 is sequentially located above an elevating mechanism (not shown). The elevating mechanism raises each cassette 1 sequentially into the detection path of a spectrophotometric analysis device 80 which includes a light source 81 having a number of individual light sources equal to the number of test tubes in each cassette (in the preferred embodiments eight or twelve light sources) and a light detector 82 having a number of light detectors equal to the number of light sources and also equal to the number of test tubes in each cassette (again, preferably eight or twelve). When the elevator raises the cassette 1 into the light path between the light sources and the light detector, a spectrophotometric analysis is performed. Further, when each cassette has a bar code label for each test tube, the bar code will be read at the same time the spectrophotometric analysis is being made, thus ensuring that the results are directly linked with an identifying number.

In particular, the device includes an elevator system 92 to vertically feed cassette loaded racks 50 onto a transport belt system 91 in a housing 101 to move individual racks 50 of cassettes 1 into the spectrophotometric analysis device 100. Inside the device 95 with a supporting surface 96, the individual cassettes are sequentially positioned over an elevating device and lifted sequentially into the light path of the eight or twelve parallel light sources 97 and detectors 98 for analysis. After analysis, the racks are moved into a vertical elevator 103 for storage. Vertical movement is on supports 93.

Figure 10A:
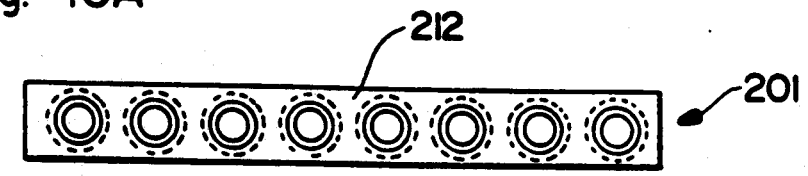
Figure 10B:
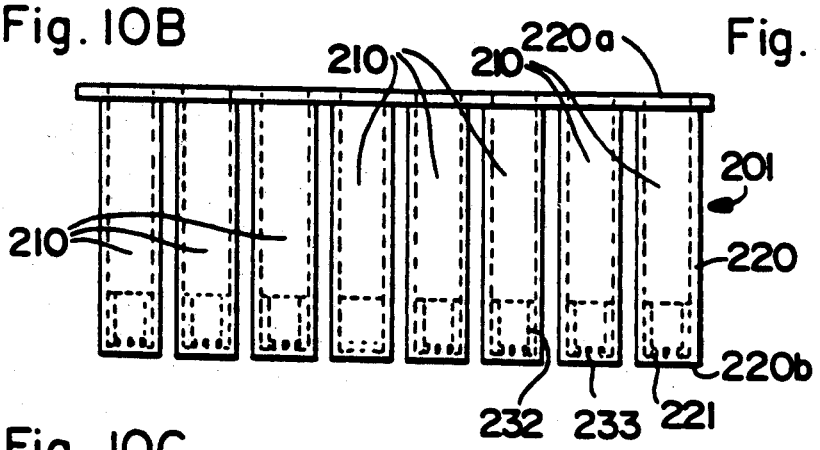
Figure 10E:
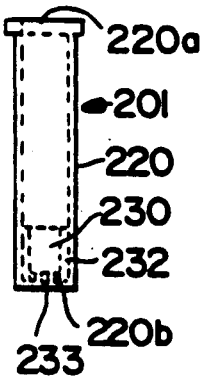
Figure 10C:
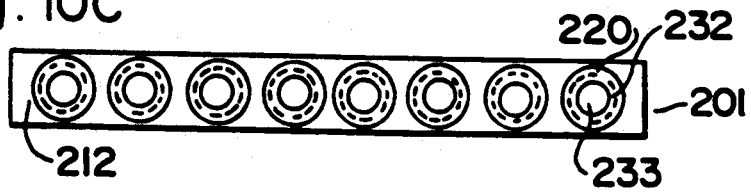
Figure 10F:
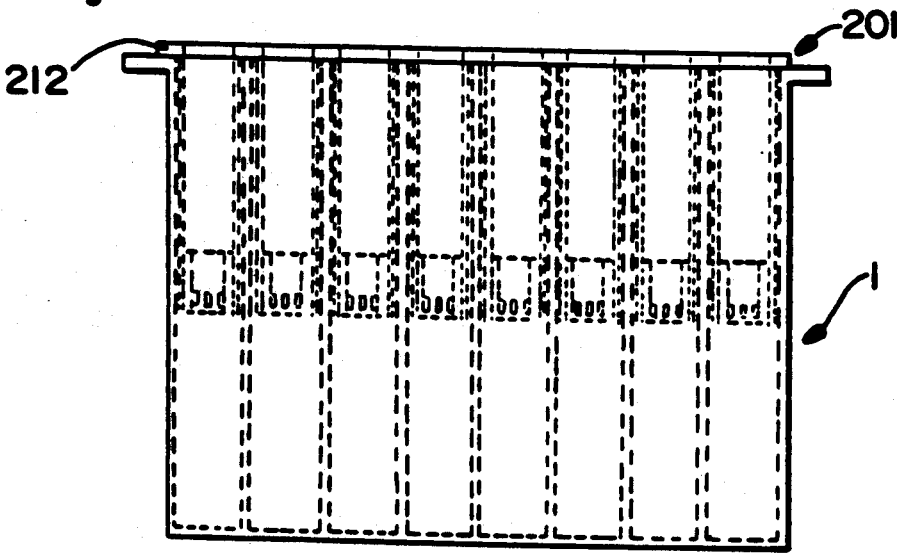

FIGS. 10(A)-(F) illustrating filter cassette in accordance with a preferred embodiment of the present invention. As shown in FIG. 10(F) the filter cassette 201 is preferably dimensioned such that it can be inserted into a test tube cassette 1. The filter cassette 201 is provided with a plurality of filter inserts 210 preferably equal in number to the number of test tubes in the test tube cassette 1 (typically eight or twelve).

As best shown in FIGS. 10(B) and 10(E), each filter insert 210 comprises a elongated tubular portion which is open at both its upper end 220(A) and its lower end 220(B). The lower end 220(B) is formed with a radially inward extending annular flange 221. A filter element 230 is inserted into the filter insert and supported by the annular flange 221. The filter element 230 comprises a short tubular portion 232 having an annular outer surface and sealing contact with the annular surface of the elongated tubular portion 220 and a generally circular filter 233 supported at the lower end of the short tubular portion 232. Preferably the filter is constructed of paper or a similar filtering medium.

As best shown in FIG. 10(A), the individual filter inserts 210 are connected to and positioned with respect to one another via a planar connecting surface 212. As best shown in FIG. 10(F), the planar connecting surface 212 extends beyond the edges of the test tubes of a test tube cassette such that, if desired, the planar surface 212 can seal the open ends of the test tubes. As is also evident from FIG. 10(F), the filter cassette is supported on the test tube cassette via the lower surface of the planar connecting surface 212.

As shown in FIGS. 10(A) and 10(C), the filter inserts may have a round cross section. Alternatively, the filter inserts 210 could have a cross sectional shape corresponding to the cross sectional shape of the test tubes 10 of the test tube cassette 1 such that the outer surface of the filter inserts 210 made sealing contact with the inner surface of the test tubes 10. Additionally, although not shown, a stopper means may be provided to seal the upper edge 220(A) of the filter inserts 210. Specifically, separate stoppers for each filter insert 210 may be provided, a strip of stoppers similar to those shown in FIG. 8 can be provided, or a stopper means formed integrally with the filter cassette may be provided.

As best shown in FIGS. 10(B) and 10(E) each filter insert 210 comprises a elongated tubular portion which is opened at both its upper end 220(A) and its lower end 220(B). The lower end 220(B) is formed with a radially inward extending annular flange 221. A filter element 230 is inserted into the filter insert and supported by the annular flange 221. The filter element 230 comprises a short tubular portion 232 having an annular outer surface in sealing contact with the annular inner surface of the elongated tubular portion 220 and a generally circular filter 233 supported at the lower end of the short tubular portions. Preferably the filter is constructed of paper or a similar filtering medium.

As described above, the test tube cassette system of the present invention obviates the problems of known sample storage systems. Specifically, the use of rectilinear test tubes allows for a greater volumetric capacity than conventional round tubes. In a normal case, the volumetric capacity in a rectilinear tube is more than 120% of that of a conventional round tube having the same height. Furthermore, the use of a cassette having planar side walls in conjunction with the use of optically clear crystal polystyrene yields test tubes having superior optical characteristics as compared to micro test plates and round test tubes for at least two reasons. First, the nearly parallel sides provide more uniform and superior light transmission through the sample than possible in chrome currently available 96-well sample containers. Second, the parallel sides define a fixed light path in comparison to the variable light path in the 96-well plate, which is determined by the volume of the sample in the plate in the shape of the meniscus.

Further, the integral formation of a row of test tubes into a cassette permits automatic processing of samples not obtainable with individual test tube compartments. Moreover, use of integrally formed test tubes in conjunction with the use of a rack and positioning means located on both the rack and the cassettes allows the precise positioning of each of the test tubes in the array of test tubes (preferably and eight by twelve array) within the rack. Thus, the cassette system of the present invention is particularly compatible with liquid handling equipment developed for 96-well microtiter plates.

What is claimed is:

1. An asymmetrical test tube cassette for use in a cassette system, the cassette comprising:

a pair of spaced parallel exterior side walls having straight top, bottom and side edges;

a pair of parallel exterior end walls having straight top, bottom and end edges, the end walls being integrally connected to the side walls along the respective side edges of the end walls and side walls;

a planar exterior bottom wall extending between the bottom edges of the side walls and end walls, the side walls, end walls and bottom walls together defining a fluid-tight cassette chamber with an opening defined by the straight top edges of the side walls and end walls;

a plurality of dividing walls, the dividing walls being integrally formed with the side walls and bottom walls and extending within the chamber between the side walls so as to divide the chamber into a plurality of fluid-tight test tubes, each test tube defined by two planar end walls and two planar side walls, each test tube side wall being a portion of the cassette side wall and each test tube having a substantially rectangular cross-section; and a planar rear extension extending from one end of the cassette and a planar front extension extending from the other end of the cassette, the front and rear extensions having different shapes such that the cassette is asymmetric so as to aid in proper placement of the cassette in the cassette system.

2. The cassette of claim 1, further comprising at least one cassette positioning protrusion extending from at least one of the planar extensions and the exterior walls of the fluid-tight chamber.

3. The cassette of claim 1, wherein the cassette is formed of optically clear crystal polystyrene and the side walls of the cassette have a substantially uniform thickness so as to provide constant optical clarity along substantially the entire length of each of the test tubes.

4. The cassette of claim 1, wherein each of the fluid-tight test tubes has a central axis defined as the line which is equidistant from both pairs of opposed walls which define the rectilinear test tube and wherein the central axes of adjacent test tubes within the cassette are spaced from each other by between 0.35 inches and 0.36 inches.

5. The cassette of claim 1, wherein each of the end walls has a planar exterior surface.

6. The cassette of claim 1, wherein each of the side walls has a planar exterior surface.

7. The cassette of claim 1, wherein the planar front extension has a curvilinear shape as viewed from the top of the cassette and the planar rear extension has a rectangular shape as viewed from the top, the difference in shapes yielding the assymmetry of the cassette.

8. The cassette of claim 1, wherein at least one of the planar extensions having a visible alpha numeric symbol placed thereon.

9. The cassette of claim 8, wherein the alpha numeric symbol alone yields the assymmetry of the cassette.

10. The cassette of claim 1, wherein the planar extension is molded to include an alpha numeric symbol on at least one of the planar extensions.

11. The cassette of claim 1, wherein each planar extension is molded to include a unique alpha numeric symbol, the difference between the alpha numeric symbols resulting in a cassette which is assymmetric.

12. The test tube cassette of claim 1, wherein said planar surfaces of said dividing walls converge toward one another at an angle of less than one degree.

13. The test tube cassette of claim 1, wherein said cassette is molded of optically clear crystal polystyrene.

14. The test tube cassette of claim 1, wherein at least seven equispaced dividing walls are provided so as to define at least eight substantially identical test tubes.

15. The test tube cassette of claim 1, wherein positioning means are provided proximate the planar protrusions.

16. The test tube cassette of claim 1, further including at least label attached to said cassette, said at least one label comprising at least one of a bar code and an alpha numeric code for identifying the contents of each of said plurality of test tubes.

* * * * *